United States Patent [19]

Neyret

[11] 4,391,112

[45] Jul. 5, 1983

[54] PISTON-TYPE LOCKS

[75] Inventor: Guy Neyret, Oullins, France

[73] Assignee: Sodex-Magister, Societe d'Exploitation, Croissy, France

[21] Appl. No.: 167,283

[22] Filed: Jul. 9, 1980

[30] Foreign Application Priority Data

Jul. 23, 1979 [FR] France ..... 79 18918

[51] Int. Cl.[3] ..... E05B 9/04; E05B 27/04

[52] U.S. Cl. ..... 70/364 A; 70/373

[58] Field of Search ..... 70/373, 374, 364 A, 70/372, 357

[56] References Cited

U.S. PATENT DOCUMENTS 1,020,874 3/1912 Augenbraun ..... 70/373
1,433,362 10/1922 Freysinger ..... 70/373
1,433,363 10/1922 Freysinger ..... 70/373
2,755,656 7/1956 Schwartz ..... 70/364 A

*Primary Examiner*—Robert L. Wolfe
*Attorney, Agent, or Firm*—James Creighton Wray

[57] ABSTRACT

The invention relates to piston-type locks preferably for use with vehicles. In the lock according to the invention the stator comprises an aperture opening at its periphery and into the said longitudinal bore, the said aperture receiving an insert comprising radial passages in each of which there are lodged a pair of pistons and a return spring, the said insert being in two parts sliding telescopically one in relation to the other to reduce the effective length of the said radial passages, the said insert comprising retractable stops for the inner radial extremity of each of the said pairs of pistons, the retraction of the said stops causing the liberation of the said pairs of pistons and the introduction of the inner pistons into the radial bores of the rotor.

7 Claims, 15 Drawing Figures

PISTON-TYPE LOCKS

BACKGROUND TO THE INVENTION

The invention relates to a piston-type lock of the type comprising a cylindrical rotor pivoting in a longitudinal bore of a stator, the said rotor comprising a longitudinal key passage and a plurality of radial bores opening into the key passage and to the periphery of the rotor, the said stator comprising a plurality of bores opening into the longitudinal bore of the stator and, in one angular position of the rotor, each prolonging a radial bore of the rotor, each radial bore of the rotor containing a sliding piston and each radial bore of the stator containing a sliding piston spring-loaded towards the longitudinal bore of the stator, the pistons of the rotor each co-operating with a piston of the stator in the said angular position, the inner extremities of the pistons of the rotor co-operating with the notches of a coded key introduced into the key passage in such manner that the other extremities of the said pistons of the rotor are flush with the periphery of the rotor.

While locks of this type offer great security by reason of the multiplication of the number of combinations and their resistance to force, their fitting is very delicate and difficult to automate.

In order to facilitate the fitting of these locks it has been proposed to lodge the stator pistons with their springs in a separate support which is then fixed to the stator, the pistons being liberated after fitting of the rotor. This proposal improves the fitting of the locks but renders the assembling of the lock still more difficult. Moreover it necessitates mutually identical pistons for the stator.

OBJECT OF THE INVENTION

The present invention aims at considerably simplifying the assembling of piston-type locks and at permitting the automation of the fitting and assembling, without loss of the mechanical qualities of piston-type locks.

SUMMARY OF THE INVENTION

To this end the lock according to the invention is characterised in that the stator comprises an aperture opening to its periphery and into the said longitudinal bore, the said aperture receiving an insert comprising radial passages in each of which a pair of pistons and a return spring are lodged, the said insert being in two parts sliding telescopically one in relation to the other to reduce the effective length of the said radial passages, the said insert comprising retractable stops for the radial inner extremity of each of the said pairs of pistons, the retraction of the said stops causing the liberation of the said pairs of pistons and the introduction of the inner pistons into the radial bores of the rotor.

BRIEF DESCRIPTION OF THE DRAWINGS

The invention will be clearly understood on reading of the following description given with reference to the accompanying drawing, wherein.

DESCRIPTION OF PREFERRED EMBODIMENT

Figure 1:
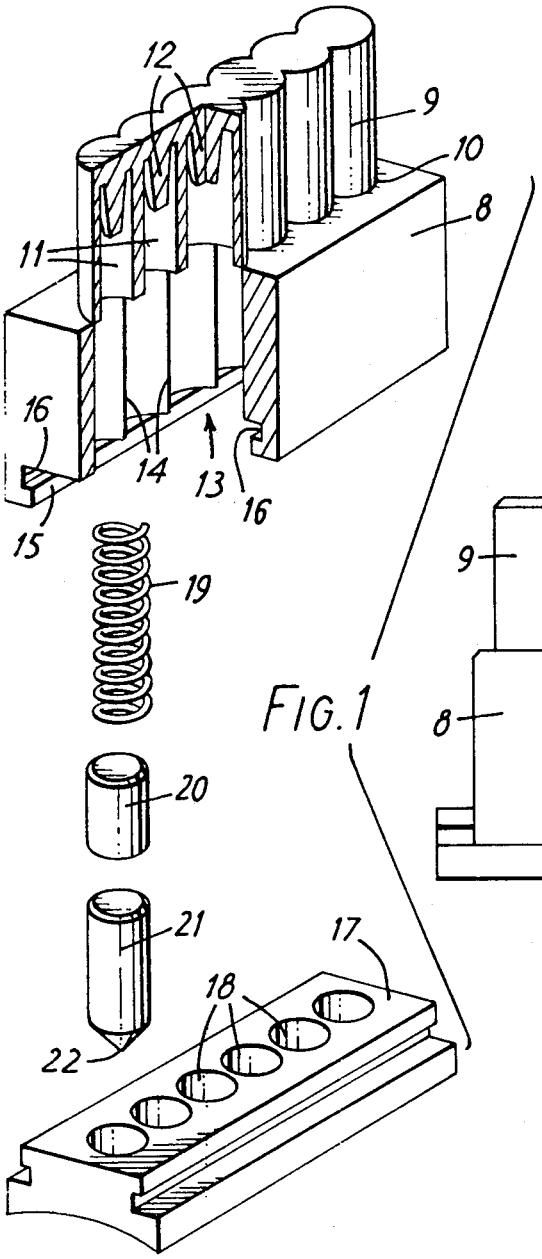
FIG. 1 is an exploded perspective view, partially in section, of an insert according to a first form of embodiment of the lock according to the invention.

Reference will be made first of all to FIGS. 1 to 7, which describe a first form of embodiment of a lock according to the invention.

The lock comprises a stator 1 equipped with a longitudinal bore 2 in which there pivots a rotor 3 provided with a longitudinal key passage 4 and radial bores 5 opening into the key passage and to the periphery of the rotor. According to the invention the stator 1 is equipped with an aperture 6 opening to its periphery and into the bore 2. The assembly as just described is analogous for the various forms of embodiment of the invention and will not be described in greater detail for the other forms of embodiment.

Figure 2:
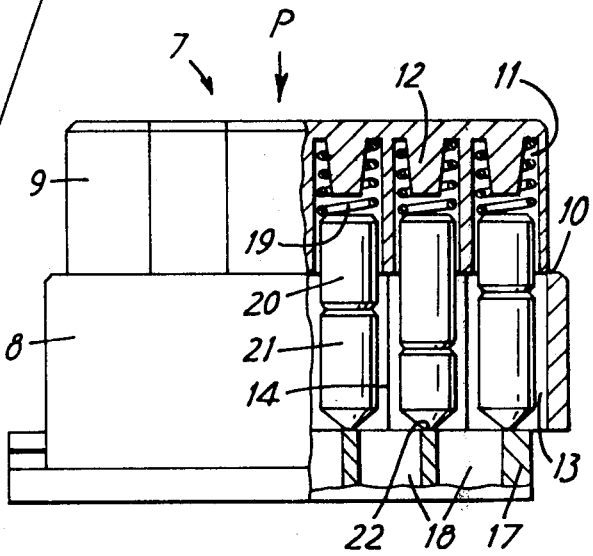
FIG. 2 is a partially sectional elevational view of the insert according to FIG. 1.

The aperture 6 is intended to receive an insert 7, represented in greater detail in FIGS. 1 and 2. The insert 7 comprises a casing in two parts 8 and 9, the part 9 being able to slide in relation to the part 8 in order to be lodged completely therein. The casing can be of plastic material or metal. The parts 8 and 9 can be independent of one another or can preferably be in one single piece, their connection line 10 being of slight resistance so that it can be broken away under a pressure in the direction P (FIG. 2) to separate the two parts and permit their relative sliding.

The part 9 comprises a plurality of radial bores 11 terminating away from the part 8 with an end piece equipped with a central nipple 12. The part 8 comprises a central cavity 13 into which the bores 11 open and which is open away from the part 9. The cavity 13 comprises ribs 14 prolonging the separating walls of the bores 11. The base of the part 8 further comprises a lateral slot 15 prolonged into the walls of the cavity 13 by two grooves 16.

A metallic closure plate 17 is mounted for sliding across the slot 15 along the grooves 16. The plate 17 comprises as many through-passing bores 18 as the part 9 comprises bores 11, with the same section and the same spacing.

The parts 8 and 9 contain, in each bore 11 and the volume defined by the ribs 14 extending it into the part 8, a spring 19 abutting on the end of the bore 11 and retained by the nipple 12, a stator piston 20 and a rotor piston 21. The end of the piston 21 away from the piston 20 comprises a point 22 which, in the position for fitting of the insert (FIG. 2), abuts on the solid surface between two bores 18 of the plate 17 or upon the end of the plate, the plate 17 being offset to the left (in the drawing).

Figure 3:
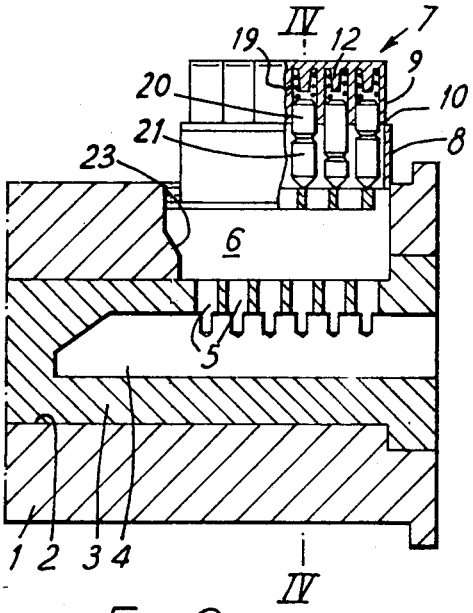
FIG. 3 is a diagrammatic axial sectional view, partially in elevation, of a lock with the insert according to FIGS. 1 and 2 in a first fitting phase.
Figure 4:
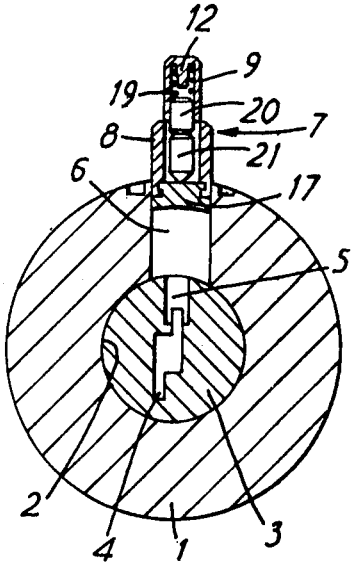
FIG. 4 is a sectional view along the line IV—IV in FIG. 3.
Figure 5:
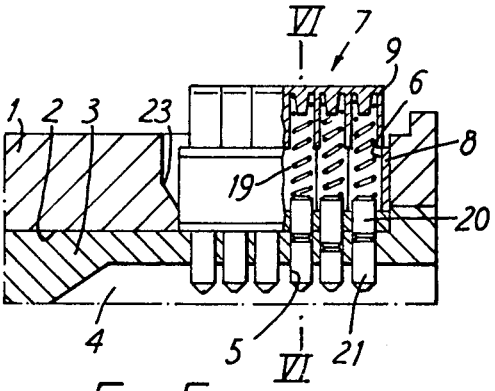
FIG. 5 is a view in axial half-section, partially in elevation, of the lock according to FIGS. 3 and 4, in a second fitting phase.
Figure 6:
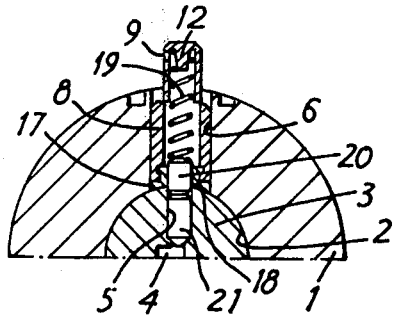
FIG. 6 is a sectional view along the line VI—VI in FIG. 5.
Figure 7:
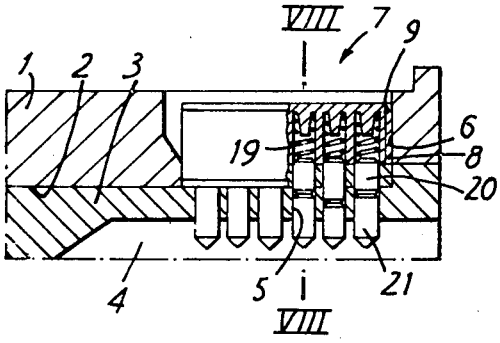
FIG. 7 is analogous with FIG. 5, the lock being completely fitted.
Figure 8:
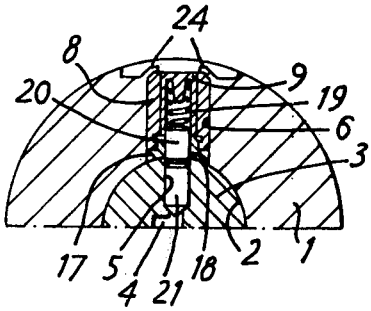
FIG. 8 is a sectional view along the line VIII—VIII in FIG. 7.

In this position the insert is introduced into the aperture 6 of the stator 1 (FIGS. 3 and 4). This aperture 6 comprises, on the side where the plate 17 overhangs, a ramp 23 so that when the insert is pushed into the aperture 6 the plate 17 is pushed to the right (FIGS. 5 and 6) and the bores 18 come opposite to the pistons 21. The springs 19 expand and push the pairs of pistons 20, 21 downwards (in the drawing). The rotor pistons 21 come at least partially to lodge in the bores 5 of the rotor 3. Then the part 9 is driven into the part 8, this compressing the springs 19, and the edges 24 of the aperture 6 are turned down on to the insert (FIG. 8) to hold it in place. In this manner the effective length of the passages of the stator, limited by the stop 12, no longer permits lodgement of the pair of pistons and prevents liberation of the rotor by re-ascent of these pairs as a whole into the stator. The lock is thus ready for use, a plate (not shown) being able to bar access to the insert.

The insert ready for fitting is thus a part which can be fixed on the lock in the last stage of manufacture. A suitable number of inserts of the same combination with the corresponding keys can thus be manufactured and stored and assembled at the last moment to form, for example in the case of an automobile vehicle, the anti-theft lock, the door locks, the boot lock, etc. The manufacture of the insert can easily be automated.

Figure 9:
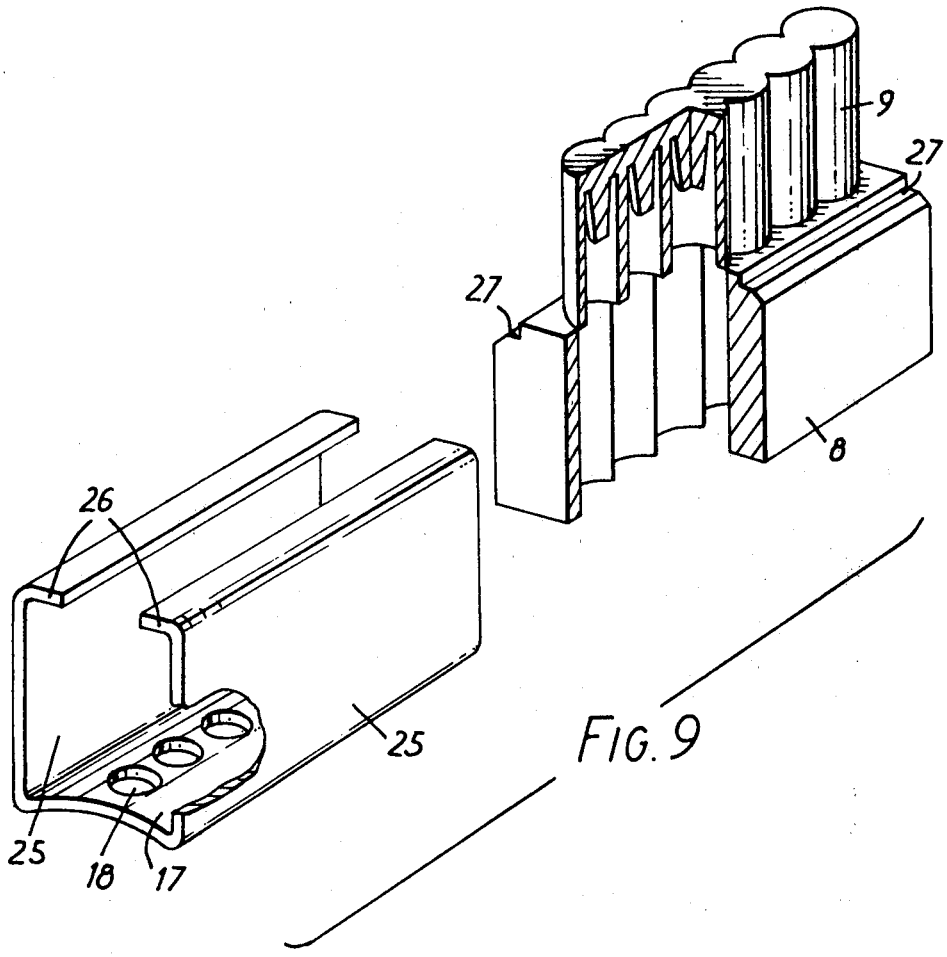
FIG. 9 is a diagrammatic exploded perspective view, partially in section, of an insert according to a second form of embodiment of the lock according to the invention, without the pistons and springs.
Figure 10:
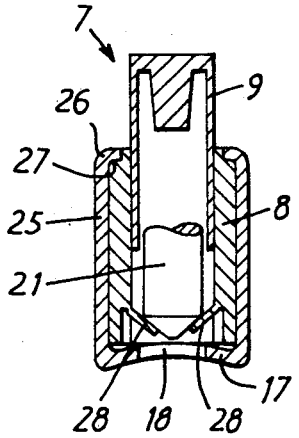
FIG. 10 is a radial sectional view of the insert according to FIG. 9, before fitting, a part of a piston being represented in elevation.
Figure 11:
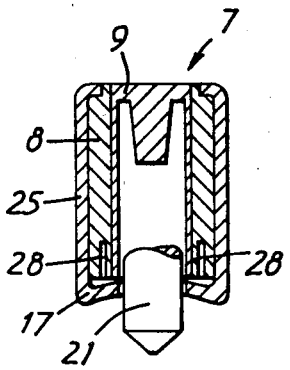
FIG. 11 is analogous with FIG. 10, but after assembling.
Figure 12:
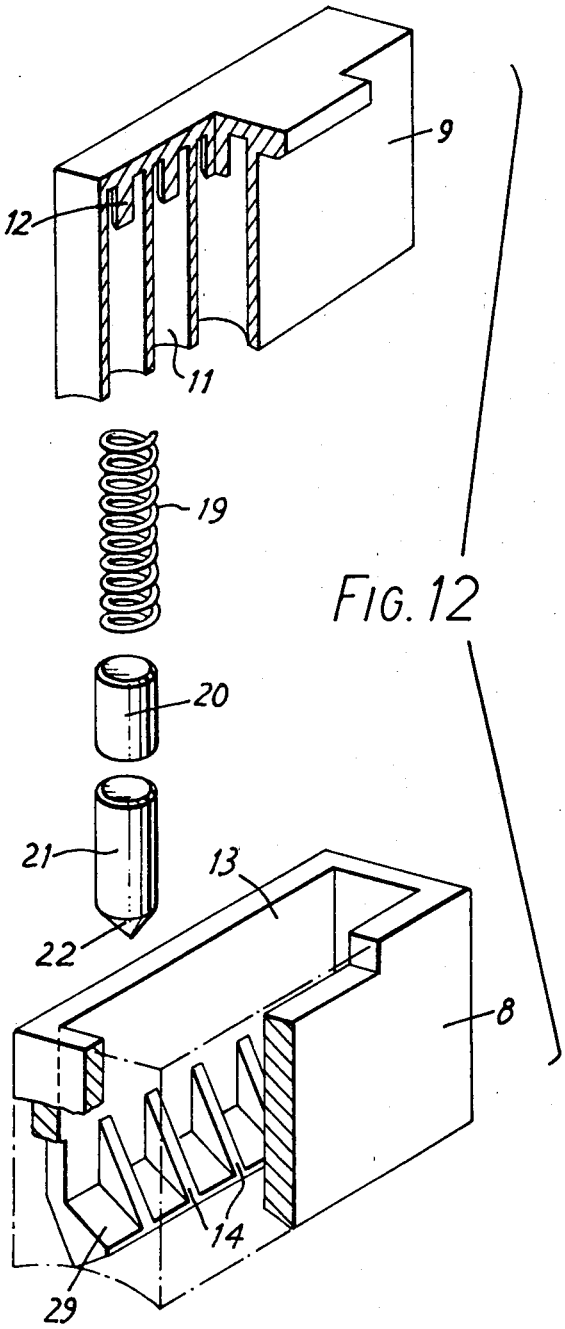
FIG. 12 is a diagrammatic exploded perspective view, partially in section, of an insert according to a third form of embodiment of the lock according to the invention.
Figure 13:
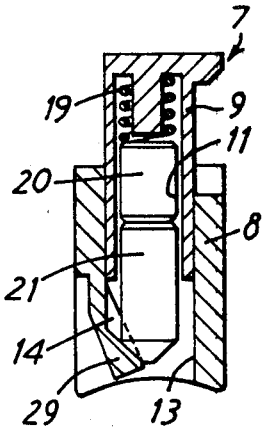
FIG. 13 is a radial sectional view of the insert according to FIG. 12, before fitting.
Figure 14:
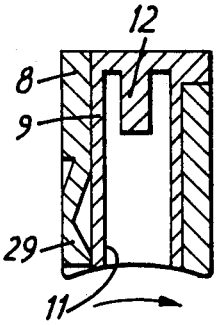
FIG. 14 is a radial sectional view of the insert according to FIGS. 12 and 13, after fitting, the pistons and springs not being represented.
Figure 15:
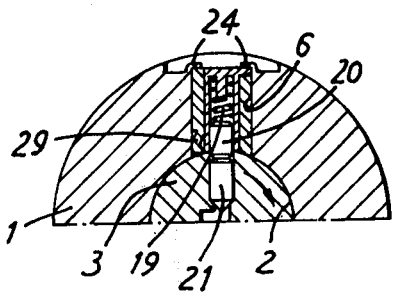
FIG. 15 is a radial half-sectional view of a lock equipped with the insert according to FIGS. 12 to 14, after assembly and fitting.

In the form of embodiment according to FIGS. 9 to 11, the insert 7 constituted by the parts 8 and 9 is similar to that of the previous form of embodiment. The plate 17 is prolonged on each side by walls 25 equipped with a flange 26 which slides in a groove 27 formed on the upper edge of the part 8. Moreover the part 8 comprises elastic tongues 28 disposed so as to retain the pistons 21 (FIG. 10).

When the part 9 is driven into the part 8 (FIG. 11) the part 8 elastically pushes back the tongues 28 so as to free the pistons which come to occupy their working position. In this form the plate 17 occupies its fitting position in the position of assembling of the insert, the bores 18 being coaxial with the pistons and the latter being retained by the tongues 28.

In the form of embodiment according to FIGS. 12 to 15 the parts 8 and 9 of the insert 7 are independent, the part 8 advantageously being of plastic material and the part 9 metallic. The cavity 13 is partially closed by an inclined strip 29 prolonging one of the larger walls of the cavity. The strip 29, which carries the separating ribs 14, is elastically deformable. In the position for assembling of the insert (FIG. 13) the pistons 20, 21 are retained in the insert, despite the pressure of their springs 19, by abutment of the stator piston 21 against the strip 29. When the part 9 is driven into the part 8 the strip 29 is pushed back elastically and the pistons are freed to occupy their working position. The insert can be retained in place by turning down of the edges 24 (FIG. 15) of the cavity 6, as in the first case. This form of embodiment avoids the use of a guide plate 17, the guidance and resistance being effected by the walls of the bores 11 of the metallic part 9. The assembling of the insert is further simplified and can be automated more easily, all the parts being introduced by parallel translational movements.

I claim:

1. A piston-type lock comprising:

(a) a stator, (b) a cylindrical rotor pivoting in a longitudinal bore of the stator, said rotor comprising a longitudinal key passage and a plurality of radial bores opening into the key passage and to the periphery of the rotor, said stator comprising a plurality of bores opening into the longitudinal bore of the stator and each continuing, in one angular position of the rotor, a radial bore of the rotor, (c) a sliding piston within each radial bore of the rotor, (d) a sliding piston within each radial bore of the stator spring-loaded towards the longitudinal bore of the stator, the pistons of the rotor each cooperating with a piston of the stator in the said angular position, the inner extremities of the pistons of the rotor cooperating with the notches of a coded key introduced into the key passage in such manner that the other extremities of the said rotor pistons are flush with the periphery of the rotor, said stator comprising an aperture opening at its periphery and into the said longitudinal bore, (e) an insert within said aperture having radial passages, and (f) a pair of pistons and a return spring located within each radial passage, said insert being in two parts sliding telescopically one in relation to the other to reduce the effective length of said radial passages, (g) said insert comprising retractable stops for the inner radial extremity of each of the said pairs of pistons, the retraction of the said stops causing the liberation of the said pairs of pistons and the introduction of the lower pistons into the radial bores of the rotor.

2. A lock according to claim 1, wherein the said stops are constituted by elements fast with one of the parts and retracted by telescopic sliding of the other part.

3. A lock according to claim 1, wherein a metallic plate equipped with bores for the passage of the pistons is fitted for sliding on the inner extremity of the insert.

4. A lock according to claim 1, wherein the insert is held in place by turning down of the edges of the receiving aperture.

5. A lock according to claim 1, wherein the two parts of the insert are arranged so that their relative sliding causes retraction of the said stops.

6. A lock according to claim 1, wherein the two parts of the insert are formed in one single piece of plastic material comprising a tear-off line separating the two parts.

7. A lock according to claim 1, wherein one of the parts of the insert is metallic and the other is of plastic material.

* * * * *